US006247989B1

(12) United States Patent
Neff

(10) Patent No.: US 6,247,989 B1
(45) Date of Patent: Jun. 19, 2001

(54) SECONDARY LIFT FLYING RING

(76) Inventor: Richard D. Neff, 103 Woodward Ave., Springville, NY (US) 14141

( * ) Notice: Subject to any disclaimer, the term of this patent is extended or adjusted under 35 U.S.C. 154(b) by 0 days.

(21) Appl. No.: 09/298,881

(22) Filed: Apr. 26, 1999

(51) Int. Cl.[7] ..... A63H 27/00; A63B 65/10; A63B 67/06; A63B 65/08

(52) U.S. Cl. ..... 446/46; 446/47; 446/48; 473/588; 473/589; 473/590

(58) Field of Search ..... 446/46, 47, 48; 473/588, 589, 590

(56) References Cited

U.S. PATENT DOCUMENTS

| | | |
|---|---|---|
| 3,312,472 | 4/1967 | Kerr . |
| 3,363,899 | 1/1968 | Gross . |
| 3,580,580 | 5/1971 | Wark et al. . |
| 3,594,945 | 7/1971 | Turney . |
| 3,802,704 | 4/1974 | Genua . |
| 4,196,540 | 4/1980 | Hembree et al. . |
| 4,216,611 | 8/1980 | Psyras . |
| 4,456,265 | 6/1984 | Adler . |
| 4,560,358 | 12/1985 | Adler . |
| 4,669,996 | 6/1987 | Bershak . |
| 4,820,230 | 4/1989 | Richards . |

OTHER PUBLICATIONS

*Steven Cany's Invention Book* by Steven Caney Workman-Publishing Company Inc. New York, NY 1985 pp. 97–102 (The Invention of the Frisbee).

*Primary Examiner*—Robert A. Hafer
*Assistant Examiner*—Urszula M. Cegielnik

(57) ABSTRACT

A flying toy in the form of an aerodynamic flying ring. An annular disk (17) surrounds a central opening (12) to create a ring. A convex upper surface (11) deflects air flowing over the top side of the disk, increasing air speed and reducing downward air pressure. An aerodynamic protruding annular fin (27) located near the inner perimeter (18) of the unit deflects air upward again, increasing air speed and decreasing air pressure again. The lower side of the unit contains an undercut that can be straight (16), curved (20), or angled (22). This undercut creates a lower cutaway surface (19) which may be parallel to, or at an angle to, the horizontal plane. This structure captures air beneath the unit, slowing air speed and increasing upward air pressure on the unit. These features combine to provide greater lift capacity than any of them would produce separately. In the preferred embodiment the disk is made of a soft foam material such as polyethylene or polyurethane, but other materials could be used. Alternative embodiments of the invention contained numbered panels (28) and catching areas (29) which can be used to play a variety of tossing and catching games.

8 Claims, 3 Drawing Sheets

SECONDARY LIFT FLYING RING

BACKGROUND OF THE INVENTION

1. Field of the Invention

This invention relates to throwing toys, and, more specifically to aerodynamic flying rings which can be adapted to game playing purposes.

2. Prior Art

There have been a number of prior flying rings. Some of these are listed below:

U.S. Pat. No. 3,312,472—Kerr

U.S. Pat. No. 3,580,580—Wark & Schladermundt

U.S. Pat. No. 3,594,945—Turney

U.S. Pat. No. 3,363,899—Gross

U.S. Pat. No. 3,802,704—Genua

U.S. Pat. No. 4,196,540—Hembree & Shea

U.S. Pat. No. 4,216,611—Psyras

U.S. Pat. No. 4,456,265—Adler

U.S. Pat. No. 4,560,358—Adler

U.S. Pat. No. 4,669,996—Bershak

U.S. Pat. No. 4,820,230—Richards

In U.S. Pat. No. 3,312,472, Kerr discloses an annular disk incorporating elevated sections on both the top and bottom surfaces. This enables the disk to maintain a substantially horizontal path while in flight, which is appropriate in that the disk is meant to be thrown toward a fixed target in the form of a peg or post.

In U.S. Pat. No. 3,580,580, Wark & Schladermundt disclose an annular disk incorporating flanges on the outer and inner perimeters of the disk, which help maintain a stable flight path until the spinning of the disk ceases. In U.S. Pat. No. 3,594,945, Turney discloses an annular ring having an upper convex surface and a lower flat surface, which incorporates spaced cavities which equalize weight in different portions of the annular circumference. This allows the ring to travel in a gliding motion, but does not provide additional lift. Turney also discloses a ring molded of low density polystyrene foam, which increases safety, but does not provide sufficient weight for prolonged flight.

Several other documents have disclosed disks constructed of foam material. In U.S. Pat. No. 3,363,899, Gross discloses a foam disk which is constructed in such a manner as to be launched into a cup. In U.S. Pat. No. 3,802,704, Genua describes soft foam rings which are constructed with a square cross-sectional configuration, to be used in the game of quoits. In. U.S. Pat. No. 4,820,230, Richards discloses an annular disk with a pair of mitered surfaces, constructed of a lightweight foam material. In U.S. Pat. No. 4,196,540, Hembree & Shea disclose an annular ring embodying a flat upper surface, a slightly concave lower surface, and an outer rim portion. These designs do not incorporate airfoil devices on the upper or lower surfaces. This factor combines with the light weight of the units to allow for flight paths of short to moderate height and distance.

In U.S. Pat. No. 4,669,996, Bershak discloses a flying disk incorporating a primary airfoil on the upper surface and a secondary airfoil on the lower surface of the unit. This contributes to a straighter flight path for the disk.

In U.S. Pat. No. 4,216,611, Pyras discloses an annular disk having radial extending air spoilers located in the area between the outer and inner perimeters of the unit.

Adler, in U.S. Pat. No. 4,456,265, discloses an annular disk having a convex top surface and a slightly angled bottom surface. In U.S. Pat. No. 4,560,358, he expands this design to include a lip around the outer perimeter of the unit to increase stability. These features produce a relatively level flight path which can continue over long distances.

Other interesting information concerning prior art can be found on pages 97–102 ("The invention of the Frisbee") in the book entitled "Steven Caney's Invention Book" published by the Workman Publishing Company, Inc. New York, N.Y., 1985.

One of the major disadvantages of a large portion of the prior art has been that in order to achieve distance in flight the unit was necessarily constructed of a rigid or semi-rigid plastic material. These units were not easily adaptable to use in crowded outdoor areas, where there was an increased likelihood of injury due to the rigid structure of the unit. They were also unadaptable for use indoors where there was an increased probability of property damage. These units were also unsuited for use by young children, because of the difficulty in throwing and catching due to the rigid construction of the units.

Previous units which were constructed of foam were safer to use, but did not incorporate the aerodynamic features necessary for sustained flight.

OBJECTS AND ADVANTAGES OF THE INVENTION

The herein described invention combines a unique and more effective design of airfoil which provides an additional lift factor, with the possibility, although not the necessity, of construction using a soft foam material having a tough "skin" covering the foam, and a buoyancy factor allowing the unit to be used in or near water. The unit also combines the safety factor of possible construction in a soft foam material with the optional addition of numbers and catching areas to make possible the playing of a number of games. These features constitute an advance in the field of aerodynamic toys. The unit also possesses a tough "skin" covering the entire unit, which makes the unit more durable as well as being an added safety factor when being used by young children. Further objects and advantages of this invention will become apparent from a consideration of the description and drawings which follow.

SUMMARY OF THE INVENTION

The present invention consists of an annular disk surrounding a central opening. This disk incorporates a convex upper surface, an undercut lower surface adjacent to the outer perimeter of the unit, and an aerodynamic protruding annular fin on the upper surface adjacent to the inner perimeter of the unit. This configuration leads to a decrease in air pressure above the unit as air passes over the convex upper surface, coupled with an increase in air pressure beneath the unit as air is captured and slowed by the undercut lower surface, which creates lift. The aerodynamic protruding annular fin on the upper surface adds an additional lift factor as the air speed is increased again on the upward side of the aerodynamic protruding annular fin, causing air pressure above the unit to decrease further. The unit is so configured as to permit construction using a variety of materials, including, but not limited to, soft foam or rigid or semi-rigid plastic or rubber. The preferred embodiment of the invention, which utilizes a soft foam material, exhibits the additional properties of safety for both indoor and outdoor use, and buoyancy, which makes the toy usable on or near water, as well as on land, indoors or outdoors. In the preferred embodiment the unit also comprises a tough "skin" covering the foam for greater durability. The unit can also include optional numbered areas and optional catching areas, which would make possible the use of the disk in a number of tossing and catching games.

LIST OF REFERENCE NUMBERS

Figure 1:
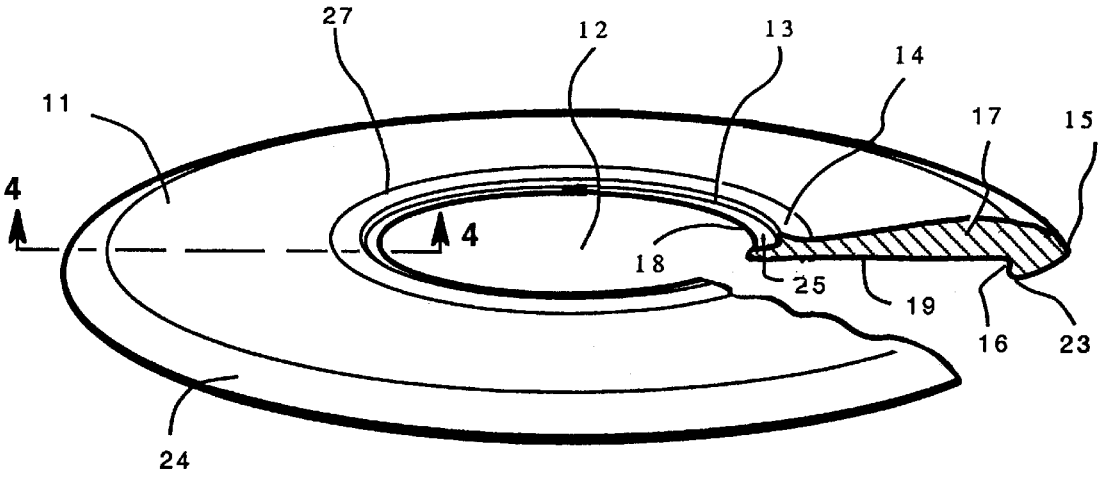
FIG. 1 is a cutaway isometric view of the unit.

11. convex upper surface
12. central opening
13. descending edge of aerodynamic protruding annular fin
14. leading edge of aerodynamic protruding annular fin
15. outer perimeter
16. straight vertical undercut
17. annular disk
18. inner perimeter
19. lower cutaway surface
20. curved vertical undercut
21. straight lower surface
22. angled vertical undercut
23. lower convex surface
24. outer skin
25. straight upper surface
26. central convex surface
27. aerodynamic protruding annular fin
28. optional numbered panels
29. optional catching areas

DESCRIPTION OF THE PREFERRED EMBODIMENT

FIG. 1 is a cutaway isometric view of the preferred embodiment of the invention. It consists of an annular disk 17 surrounding a central opening 12 to form a ring. The ring comprises a convex upper surface 11, beginning at outer perimeter 15 and continuing in the direction of central opening 12. As convex upper surface 11 approaches central opening 12, a juncture is created between convex upper surface 11, which is on a downward slope at this point, and leading edge 14 of aerodynamic protruding annular fin 27, said leading edge having an upward slant. Descending edge 13 of aerodynamic protruding annular fin 27 angles downward sharply from its juncture with leading edge 14, terminating at a juncture with straight upper surface 25.

Straight vertical undercut 16 is incorporated into the underside of annular disk 17, connecting lower convex surface 23 with lower cutaway surface 19. Lower cutaway surface 19 originates at the upper extremity of straight vertical undercut 16 and terminates at inner perimeter 18. Outer skin 24, which covers the entire outer surface of the unit in the preferred embodiment, is also shown in this figure. An alternative embodiment could consist of outer skin 24 being constructed of a rigid or semi-rigid material, possibly but not limited to a plastic material. In this embodiment outer skin 24 would enclose an air filled space. Thus, in this embodiment, annular disk 17 would have a hollow construction.

Figure 2:
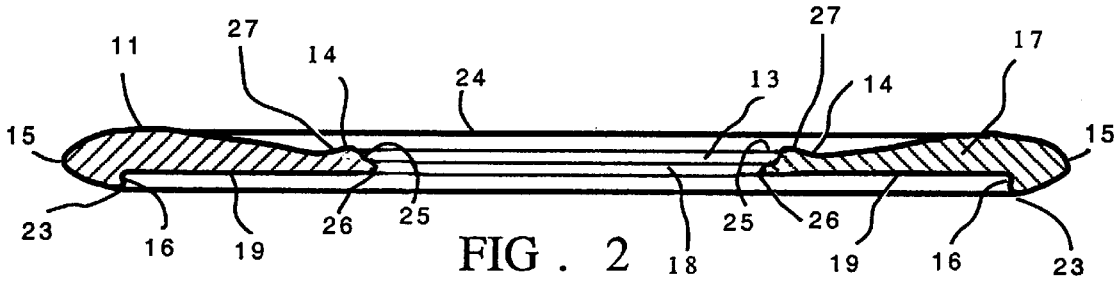
FIG. 2 is a cross section view of the unit as illustrated in FIG. 1.

FIG. 2 is a side view of one half of annular disk 17 as it would appear if the invention were bisected into two equal halves. Convex upper surface 11 is shown to originate at outer perimeter 15 and terminate at a juncture with leading edge 14 of aerodynamic protruding annular fin 27. Leading edge 14 forms a juncture with descending edge 13 of aerodynamic protruding annular fin 27. Descending edge 13 in turn forms a juncture with straight upper surface 25, which terminates at inner perimeter 18. Lower convex surface 23 proceeds in a downward direction from outer perimeter 15, terminating in a juncture with straight vertical undercut 16. Straight vertical undercut 16 connects lower convex surface 23 with lower cutaway surface 19. Lower cutaway surface 19 joins with central convex surface 26 in close proximity to central opening 12 which is illustrated in FIG. 1. Central convex surface 26 terminates at inner perimeter 18. The entire outer surface of annular disk 17 is covered with outer skin 24.

Figure 3A:
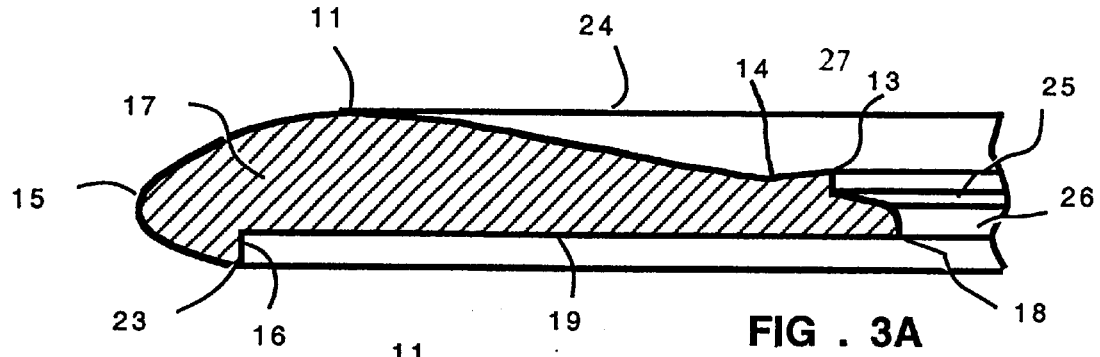
FIGS. 3A–3D show several alternative views of cross sections of the invention. These cross sections will be discussed in the disclosure that follows.

FIGS. 3A–3-D illustrate cross sections of several embodiments of the invention. They illustrate an area extending from outer perimeter 15 to inner perimeter 18 of annular disk 17. Each illustrates upper convex surface 11 originating at outer perimeter 15, which joins to leading edge 14 of aerodynamic protruding annular fin 27. Leading edge 14 is shown as having a juncture with descending edge 13, which in turn has a juncture with straight upper surface 25. Straight upper surface 25 terminates at inner perimeter 18. Outer skin 24 is also illustrated in all views.

FIG. 3A illustrates the underside of annular disk 17 comprising lower convex surface 23, straight vertical undercut 16, and lower cutaway surface 19, where lower cutaway surface 19 is parallel to the horizontal plane. Central convex surface 26 is also shown, terminating at inner perimeter 18.

Figure 3B:
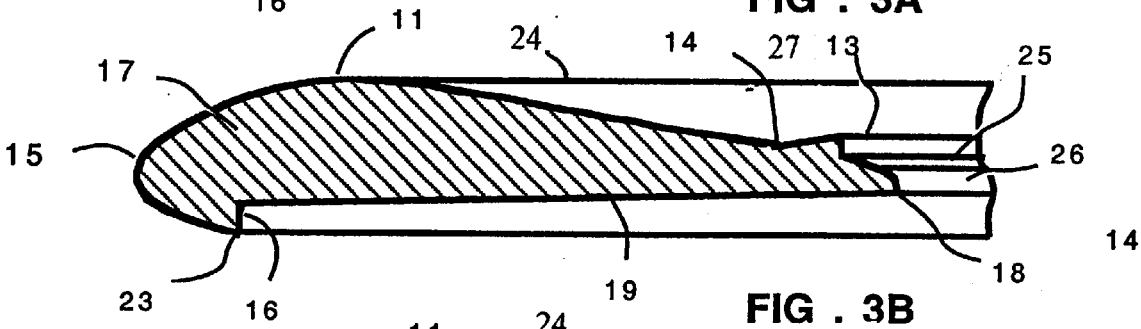

FIG. 3B illustrates the underside of annular disk 17 comprising lower convex surface 23, straight vertical undercut 16, and lower cutaway surface 19, where lower cutaway surface 19 is at an angle to the horizontal plane. Central convex surface 26 is also shown, terminating at inner perimeter 18.

Figure 3C:
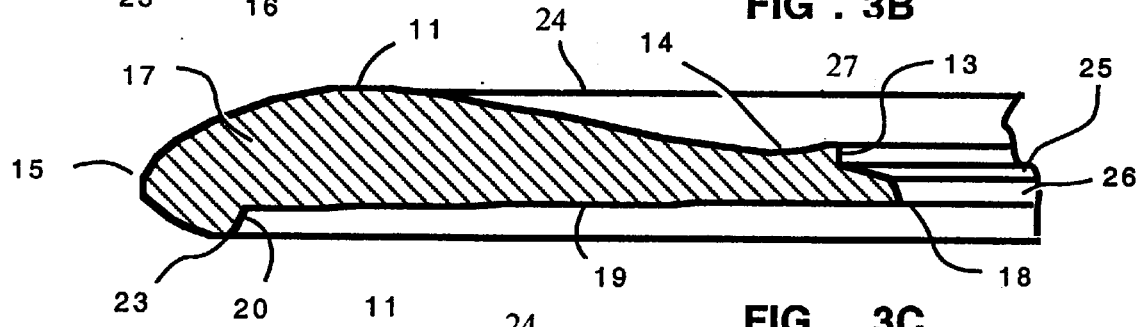

FIG. 3C Illustrates the underside of annular disk 17 comprising lower convex surface 23, curved vertical undercut 20, and lower cutaway surface 19, where lower cutaway surface 19 is at an angle to the horizontal plane. Central convex surface 26 is also shown, terminating at inner perimeter 18.

Figure 3D:
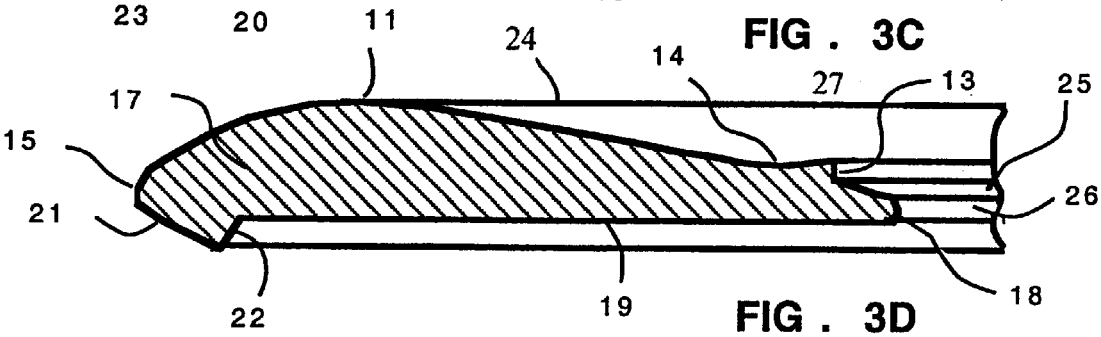

FIG. 3D illustrates the underside of annular disk 17 comprising straight lower surface 21, angled vertical undercut 22, and lower cutaway surface 19, where lower cutaway surface 19 is parallel to the horizontal plane. Central convex surface 26 is also shown, terminating at inner perimeter 18.

Other embodiments of the invention are also possible, including but not limited to: (a) a unit where the underside comprises lower convex surface 23, curved vertical undercut 20, and lower cutaway surface 19, where lower cutaway surface 19 is parallel to the horizontal plane; (b) a unit where the underside comprises lower convex surface 23, angled vertical undercut 22, and lower cutaway surface 19, where lower cutaway surface 19 is parallel to the horizontal plane; (c) a unit where the underside comprises lower convex surface 23, angled vertical undercut 22, and lower cutaway surface 19, where lower cutaway surface 19 is at an angle to the horizontal plane; (d) a unit where the underside comprises straight lower surface 21, angled vertical undercut 22, and lower cutaway surface 19, where lower cutaway surface 19 is at an angle to the horizontal plane; (e) a unit where the underside comprises straight lower surface 21, curved vertical undercut 20 and lower cutaway surface 19, where lower cutaway surface 19 is parallel to the horizontal plane; (f) a unit where the underside comprises straight lower surface 21, curved vertical undercut 20, and lower cutaway surface 19, where lower cutaway surface 19 is at an angle to the horizontal plane; (g) a unit where the underside comprises straight lower surface 21, straight vertical undercut 16, and lower cutaway surface 19, where lower cutaway surface 19 is parallel to the horizontal plane; and (h) a unit where the underside comprises straight lower surface 21, straight vertical undercut 16, and lower cutaway surface 19, where lower cutaway surface 19 is at an angle to the horizontal plane.

Figure 4:
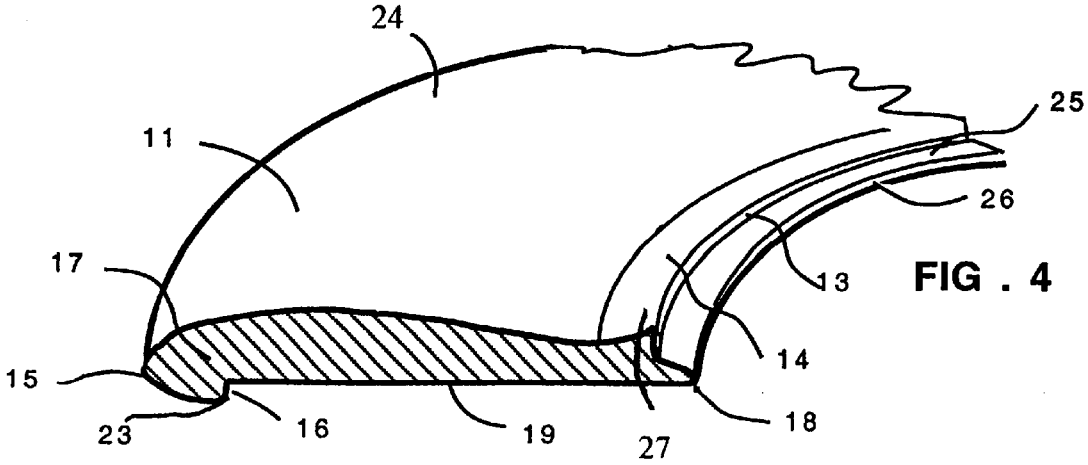
FIG. 4 is a cross sectional view of the unit as illustrated in FIG. 1, taken along line 4—4 in the direction of the arrows.

FIG. 4 is a cross sectional view of the unit as illustrated in FIG. 1, taken along line 4—4 in the direction of the arrows. A section of annular disk 17 is illustrated showing outer perimeter 15, inner perimeter 18, and outer skin 24. The upper surface of the unit comprises convex upper surface 11 which extends from outer perimeter 15 to a juncture with leading edge 14 of aerodynamic protruding annular fin 27. Leading edge 14 extends to a juncture with descending edge 13 of aerodynamic protruding annular fin 27. Descending edge 13 terminates at a juncture with straight upper surface 25, which terminates at inner perimeter 18. The underside of unit comprises lower convex surface 23, which originates at outer perimeter 15 and terminates at a juncture with straight vertical undercut 16. Straight vertical undercut 16 connects lower convex surface 23 with lower cutaway surface 19. Lower cutaway surface 19 originates at the upper extremity of straight vertical undercut 16 and terminates at a juncture with central convex surface 26. Central convex surface 26 terminates at inner perimeter 18.

Figure 5A:
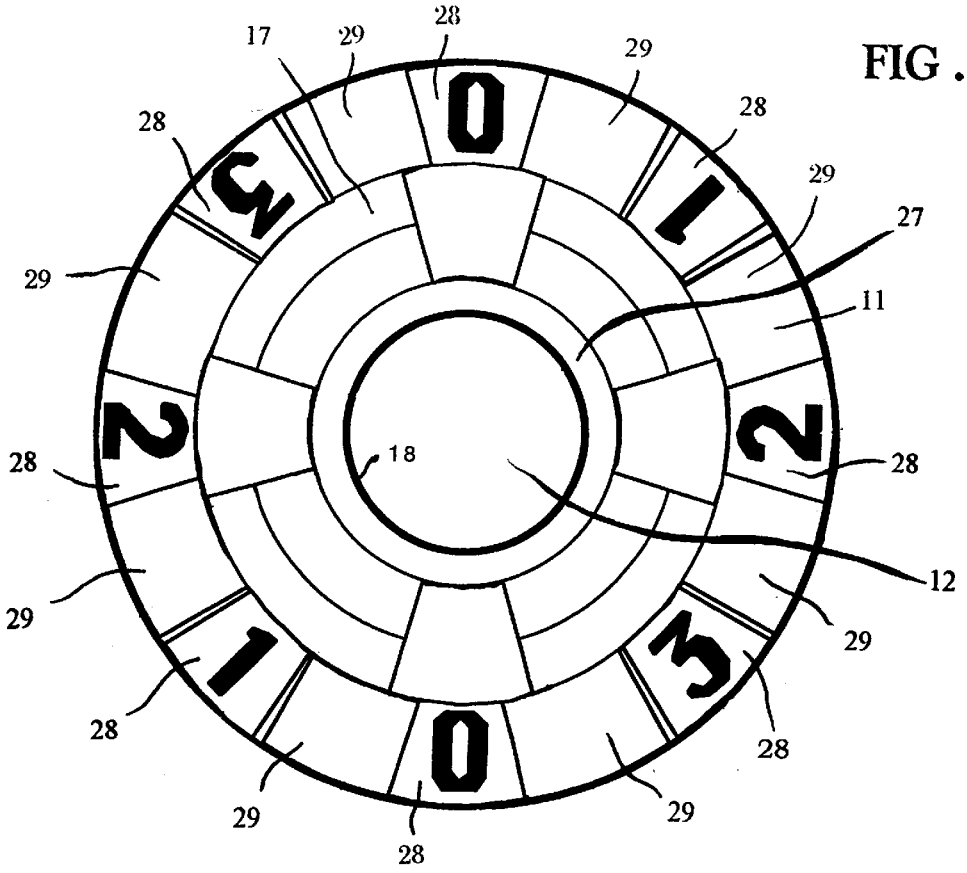
FIGS. 5A–5B show two embodiments of a top plan view of the invention, including various arrangements of numbers and catching areas for game playing purposes.
Figure 5B:
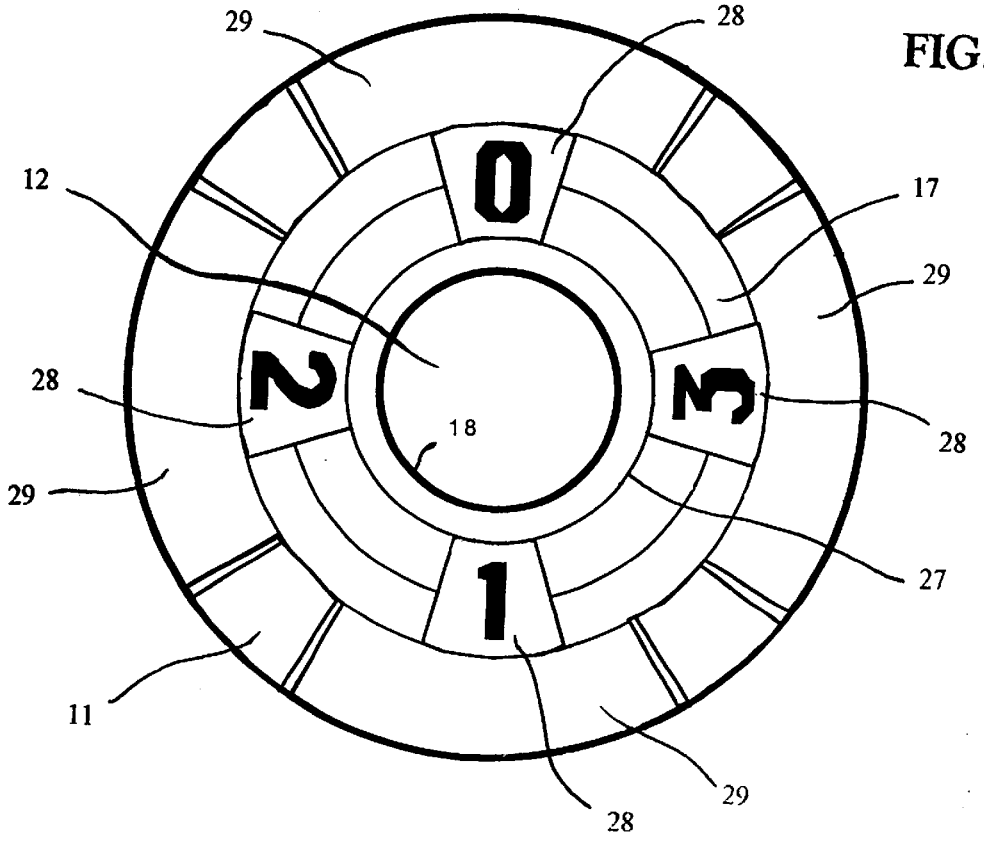

FIGS. 5A–5B illustrate alternative views of an embodiment of the invention wherein convex upper surface 11 of annular disk 17 contains aerodynamic protruding annular fin 27, located adjacent to central opening 12. Also illustrated on convex upper surface 11 are optional numbered panels 28 and optional catching areas 29. These numbered panels 28 and catching areas 29 could be positioned in various configurations, including but not limited to those illustrated in FIGS. 5A - 5B.

OPERATION OF THE INVENTION

When the invention is thrown through the air convex upper surface 11 diverts airflow in an upward direction, increasing the speed at which the air is traveling. This results in a decrease in air pressure above annular disk 17. When this airflow strikes aerodynamic protruding annular fin 27, it is once more deflected upward, more sharply this time. This diversion increases air speed and reduces air pressure once more.

At the same time air passing on the lower side of annular disk 17, which comprises lower convex surface 23, straight vertical undercut 16, and lower cutaway surface 19, is captured beneath the unit, thereby reducing speed and increasing upward air pressure. This increased air pressure on the underside of the unit combines with decreased air pressure on the upper side of the unit to create a lift factor. Since there are two areas which decrease pressure on the upper side of the unit, the lift factor is greater than could be anticipated with either of these areas alone.

The unit is configured to permit construction using a variety of materials, including but not limited to soft foam, rigid or semi-rigid plastic, or rubber. The preferred embodiment of the invention utilizes a soft foam material, including but not limited to polyethylene foam. The special aerodynamic features of this disk, which have not heretofore been incorporated into any foam disk, allow the invention to have a greater lift capacity and longer flight duration than any previous foam disks. The foam embodiment exhibits the additional properties of safety for both outdoor and indoor use, since the softness of the disk makes injuries to people or property much less likely. The unit also exhibits the property of buoyancy, which makes the unit usable on or near water as well as on land. The unit also comprises a tough outer skin 24 covering the unit which leads to increased durability of the unit. This feature also increases the safety factors, should a small child be inadvertently exposed to the unit, by making it more difficult to bite.

FIGS. 5A–5B illustrate optional numbered panels 28 and optional catching areas 29 which make the unit suitable for use in a variety of tossing and catching games. Numbered panels 28 and catching areas 29 can exist in a variety of configurations, including but not limited to more or fewer numbers on the disk, numbers located on convex upper surface 11 near outer perimeter 15 or on the upper peak of the curve, more or fewer catching areas, and various sizes of numbered panels 28 and catching areas 29.

CONCLUSION, RAMIFICATIONS AND SCOPE OF THE INVENTION

Thus, it can be seen that the invention provides an advancement in the area of foam flying disks, in that the aerodynamic features, including an upper convex surface, an aerodynamic protruding annular fin and the lower section, comprising a straight vertical undercut and a lower cutaway surface, allow the creation of a ring which has greater lift capacity than previous foam flying rings. This greater lift capacity also leads to longer flight distances than attained by previous foam flying disks.

Construction of a soft foam material, including but not limited to polyethylene foam, gives the unit in its preferred embodiment an additional safety factor over conventional hard plastic disks. The ring can be used in a crowded outdoor area, with much less danger of injuries to either participants or innocent bystanders, since even in the event the ring did strike someone, the soft material would not cause serious injuries. The unit can also be used indoors, most notably in its game playing mode where speed and distance of throws are not as much of a factor. Should the ring strike an object in this mode, the soft foam would be unlikely to cause damage. Foam also adds buoyancy to the unit, allowing it to be used more safely on a beach or around a pool, since if the unit were to land in water it would float, making retrieval easier and safer.

In the preferred embodiment of the invention the foam ring is covered with a protective outer membrane or skin. This skin increases durability of the unit by protecting the foam inside. It also allows the unit to be produced in a variety of colors, simply by changing the color of the protective skin, allowing the foam interior to remain uniform. It also allows different areas of each ring to be different colors if desired.

The unit could also be constructed of semi-rigid or rigid plastic material, or rubber. In this embodiment some of the safety factors would be sacrificed, but the improved aerodynamic principles of the design would still function in the same manner, with the added advantage of longer flight distances due to additional weight caused by the denser material. If desired a unit could be produced where only the outer skin existed, molded of plastic or some other rigid or semi-rigid material, leaving the interior of the ring as a hollow space completely enclosed within the outer skin. This embodiment would have less weight than a solid plastic unit, and would therefore operate in much the same way as the foam unit.

The unit can be manufactured in a variety of sizes, with varying diameters both of the disk itself and of the central opening. In such a case, the aerodynamic features would remain in proportion to the unit as a whole.

The underside of the unit can be configured in a variety of ways, as illustrated in FIG. 3A–3D. The lower surface leading to the undercut can be convex or straight, the undercut itself can be straight, angled, or curved, and the lower cutaway surface can be parallel to, or at an angle to, the horizontal plane. These features can be combined in any way, and are not limited to the configurations shown in FIG. 3A–3D. Other embodiments which could be created include, but are not limited to, (a) curved lower surface, angled undercut, and parallel cutaway surface; (b) curved lower surface, angled undercut, and angled cutaway surface; (c) curved lower surface, curved undercut, and parallel cutaway surface; (d) straight lower surface, straight undercut, and parallel cutaway surface; (e) straight lower surface, straight undercut, and angled cutaway surface; (f) straight lower surface, angled undercut, and parallel cutaway surface; (g) straight lower surface, angled undercut, and angled cutaway surface; (h) straight lower surface, curved undercut, and angled cutaway surface.

Therefore the scope of the invention should not be limited by the embodiments illustrated, but should be determined by the appended claims and their legal equivalents.

What is claimed is:

1. A flying ring comprising;

an annular disk constructed of soft foam material, defined by an outer perimeter and an inner perimeter, said inner perimeter surrounding a central opening, an upper surface, said upper surface comprising a convex upper surface, an aerodynamic protruding annular fin said aerodynamic protruding annular fin comprising a leading edge and a descending edge, and a straight upper surface said annular disk further defined by a lower surface, said lower surface comprising a convex lower surface, a straight vertical undercut and a lower cutaway surface, wherein said lower cutaway surface is parallel to the horizontal plane, wherein said annular disk is completely encased in a protective outer membrane and wherein said convex upper surface and said aerodynamic protruding annular fin deflect airflow in an upward direction when said annular disk is in flight and wherein said straight vertical undercut and said lower cutaway surface interrupt airflow across the underside of said annular disk, said deflection of airflow above said annular disk combining with said interruption of airflow beneath said annular disk to create a lift factor causing said annular disk to rise when in flight, said lift factor causing said annular disk to remain in flight for a longer time period.

2. The flying ring of claim 1 wherein said straight vertical undercut is constructed as an angled vertical undercut.

3. The flying ring of claim 1 wherein said straight vertical undercut is constructed as a curved vertical undercut.

4. The flying ring of claim 1 wherein said convex lower surface is constructed as a straight lower surface.

5. The flying ring of claim 1 wherein said lower cutaway surface is constructed at an angle to the horizontal plane.

6. The flying ring of claim 1 wherein said annular disk is constructed of rigid or semi-rigid material in a solid configuration.

7. The flying ring of claim 1 wherein said outer membrane is constructed of a rigid or semi-rigid material surrounding a hollow interior space.

8. The flying ring of claim 1 wherein said upper surface comprises optional numbered panels and optional catching areas to be used in game play.

* * * * *